US006027018A

United States Patent [19]

Yocum

[11] Patent Number: 6,027,018

[45] Date of Patent: Feb. 22, 2000

[54] CARTON WITH INTEGRAL PROMOTIONAL MATERIAL

[75] Inventor: James Yocum, West Chester, Pa.

[73] Assignee: Dopaco, Inc., Exton, Pa.

[21] Appl. No.: 09/262,310

[22] Filed: Mar. 4, 1999

[51] Int. Cl.[7] ..... B65D 5/42

[52] U.S. Cl. ..... 229/400; 206/459.5; 206/831; 229/906

[58] Field of Search ..... 229/400, 902, 229/906; 206/459.5, 831; 40/312, 324

[56] References Cited

U.S. PATENT DOCUMENTS

| | | | |
|---|---|---|---|
| 1,983,004 | 12/1934 | Rowland | 283/105 |
| 2,180,808 | 11/1939 | Jacobstein et al. | 283/105 |
| 2,185,392 | 1/1940 | Amdur | 283/105 |
| 3,071,882 | 1/1963 | Eisman et al. | 40/312 |
| 3,099,381 | 7/1963 | Meyers | 206/459.5 |
| 3,205,603 | 9/1965 | Brumley | 206/459.5 |
| 3,220,634 | 11/1965 | Rubinstein | 206/459.5 |
| 3,804,323 | 4/1974 | Bemel | 206/831 |
| 3,958,744 | 5/1976 | Herglotz | 206/831 |
| 4,004,691 | 1/1977 | Wihksne | 206/459.5 |
| 4,232,816 | 11/1980 | Johnson et al. | 206/831 |
| 4,252,264 | 2/1981 | Herbst et al. | 229/400 |
| 4,453,664 | 6/1984 | Oliff | 206/831 |
| 4,729,477 | 3/1988 | Growney | 206/831 |
| 4,872,555 | 10/1989 | Shadrach, III et al. | 206/831 |
| 5,007,578 | 4/1991 | Simone | 206/459.5 |
| 5,127,743 | 7/1992 | Miller et al. | 383/109 |
| 5,341,923 | 8/1994 | Arasim | 206/459.5 |
| 5,697,549 | 12/1997 | Yocum | 229/400 |

FOREIGN PATENT DOCUMENTS

| | | | |
|---|---|---|---|
| 692744 | 8/1964 | Canada | 206/459.5 |

*Primary Examiner*—Gary E. Elkins
*Attorney, Agent, or Firm*—Dennison, Meserole, Scheiner & Schultz

[57] ABSTRACT

A carton with a prize coupon formed within at least one wall of the carton and defined by peripheral severance lines. A tab, substantially smaller than the coupon, is folded over one end portion of the coupon to conceal the actual award provided by the coupon. The award is selectively exposed by a flap capable of being peeled from the tab, or an overlaid portion of the coupon.

18 Claims, 7 Drawing Sheets

FIG. 5
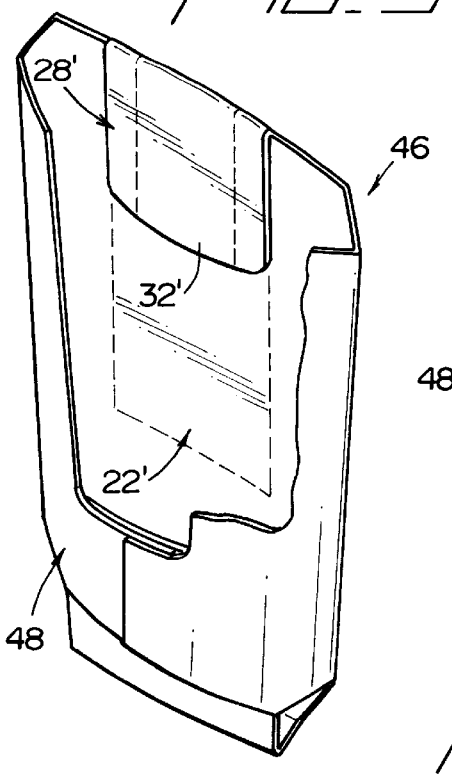
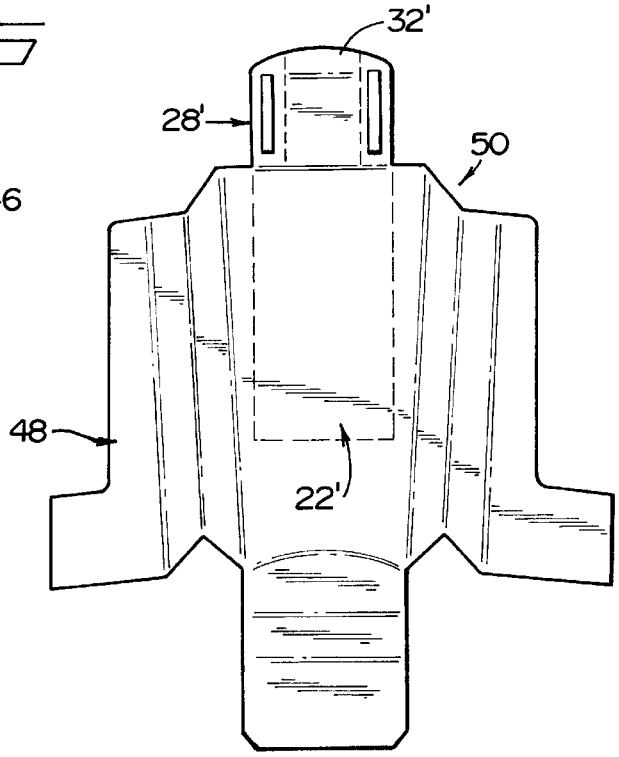
FIG. 8
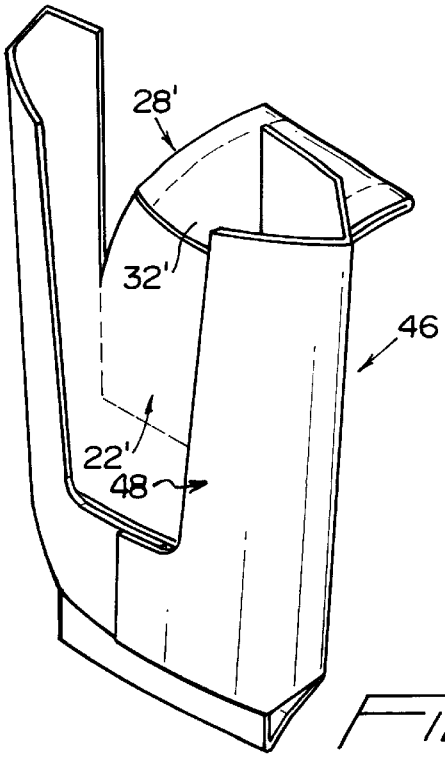
FIG. 6
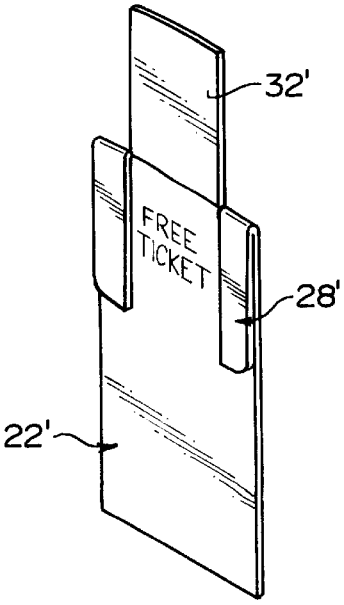
FIG. 7

CARTON WITH INTEGRAL PROMOTIONAL MATERIAL

BACKGROUND OF THE INVENTION

The invention is broadly concerned with promotional materials, prizes, and the like associated with food containers, and more particularly folded paperboard cartons of the type commonly used in fast food establishments for containing a variety of foods including french fried potatoes, hamburgers, chicken nuggets and hash brown potatoes.

Applicant's prior U.S. Pat. No. 5,697,549, issued Dec. 16, 1997, and commonly assigned with the present application, is an example of the current state of the art. Basically, the Yocum patent discloses the concept of an integrally formed tab which folds over an adjacent selectively removable portion of the carton wall for a concealing of the reward therebetween.

SUMMARY OF THE INVENTION

It is a primary object of the present invention to further advance the state of the art by building on the teaching in applicant's prior patent. In doing so, the present invention is directed to several aspects which are intended to greatly improve such integral promotional materials on fast food containers, making the promotional materials more attractive to the consumer and providing for an expanded use of such promotional means on substantially all forms of commercially available cartons.

One aspect of the invention is to specifically conform the removable coupon to the actual nature of the prize or award. For example, if the proposed prize is to be a movie ticket, the removable wall section can be in the shape of an actual elongate movie ticket with the portion thereof hidden by the concealing tab actually disclosing whether or not the ticket is valid. Other shapes, either specifically relating to the prize or of a fanciful attention directing or information providing shape can also be used. The coupons can also comprise, as an example, collectibles with pictures, quotes, riddles, or the like printed thereon as means for enhancing the sale of the products delivered within the cartons.

Other aspects of the present invention include the adaptability thereof to all forms of fast food cartons, and the use thereof in multiples, depending upon the size of the particular carton. The use of multiple coupons and tabs, in addition to allowing for the awarding the multiple prizes, also provides for the playing of "matching" games and the like.

Further details, uses and advantages of the invention will become apparent from the specifics of the invention as more in fully hereinafter presented.

BRIEF DESCRIPTION OF THE DRAWINGS

FIG. 5 is a perspective view of a hash brown box with the coupon and tab of FIG. 1 incorporated into the rear wall thereof;

FIG. 6 is a perspective view of the hash brown box with the coupon and tab partially removed;

FIG. 7 is a perspective view of the removed coupon with the tab flap opened to reveal the prize;

FIG. 8 is a plan view of the blank from which the hash brown box is formed, illustrating the integral relationship of the tab and the placement of the adhesive utilized in securing the tab closed;

DESCRIPTION OF PREFERRED EMBODIMENTS

The promotional material of the invention is intended for use with and to be formed as an integral portion of substantially any type of fast food container of folded paperboard and the like. Two significant aspects of the promotional material are the presentation thereof as a representation of the actual award, for example a full size movie ticket, and a concealed portion indicating the validity of the ticket or the possible award of a lesser prize such as a free drink.

Figure 1:
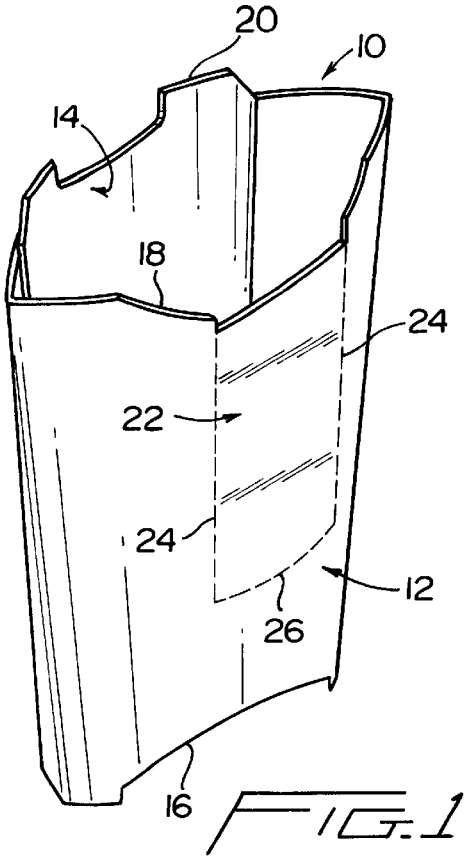
FIG. 1 is a perspective view of a typical french fry carton or scoop with the prize coupon and concealing tab of the invention integrally formed therewith.
Figure 2:
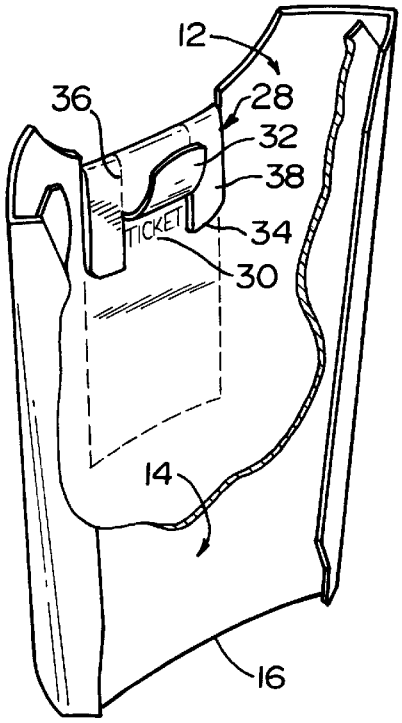
FIG. 2 is a perspective view of the rear of the coupon and tab with the tab flap partially opened.
Figure 3:
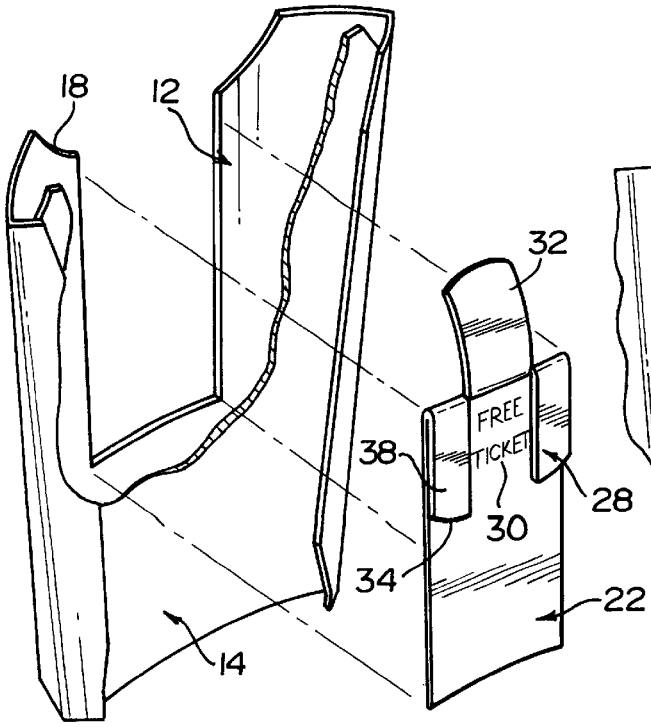
FIG. 3 is a perspective detail illustrating the prize coupon removed.

Referring now more specifically to the drawing and the invention illustrating therein, attention is initially directed to the french fry carton 10 illustrated in FIGS. 1–3. This carton 10, as is conventional, includes front and rear panels or walls 12 and 14 joined along opposed side edges either directly or with interposed side walls. The carton also includes an appropriate bottom 16 and a top, defined in the illustrated example, by the free upper edges of 18 and 20 of the front and rear walls 12 and 14 respectively.

The promotional material of the invention is defined in the front wall 12 of the carton 10 and comprises a coupon 22 formed within the front wall 12 itself downward from the upper edge 18 thereof by laterally spaced, vertical severance lines 24, for example perforations, extending downward from the top edge 18, and by a transverse bottom or inner severance line 26 interconnecting the lower ends of the vertical severance lines 24. The coupon 22, as illustrated, is of an elongate rectangular configuration having the appearance of a conventional movie ticket and thus emphasizing the nature of the potential award and enhancing the promotional aspect as an encouragement to purchasers.

As to the actual value of the award, this is a temporarily concealed from the purchaser by a concealing tab 28 formed integral with the coupon portion of the front wall 12 and, in the blank, being coplanar therewith. This tab 28, noting in particular the inner face of the wall 12 as illustrated in FIG. 2, is folded inwardly over an upper minor portion of the vertical height of the coupon 22 and conceals a minor area thereof on which the value of the award is indicated by appropriate indicia 30.

The tab 28 includes a central removable flap 32 which is defined upward from the outer edge 34 of the tab by severance lines 36 which allow for an upward peeling of the flap 22 to expose the award designating indicia 30. The actual securing of the tab 28 in its closed position is effected by adhesively bonding the tab in the side strips 38 to the opposed sides of the flap 32 directly to the inner face of the coupon 22 in any appropriate manner such as by a cold set adhesive or a co-adhesive. Secured in this manner, the flap 32, which is free of adhesive, can be easily upwardly peeled. Incidentally, as desired, the award indicating indicia 30 can be applied to the inner face of the concealing flap 32.

It is to be appreciated that the addition of the promotional material of the invention to a basic carton adds little to the cost of the carton notwithstanding the desired enlarged configuration of the coupon as an enticing display and promotional encouragement to the purchaser. Basically, the only additional material required is that sufficient so as to provide for a small concealing tab 28 which, as an integral portion of the coupon, functions to conceal the actual validity of the award suggested by the coupon and which is retained with the coupon for use or disposal therewith. No additional scraps of material, as would be the case if the tab or flap were completely severed, are present.

FIG. 3 is of interest in illustrating one manner of accessing the promotional material by a complete severing of the coupon and tab to allow ready access to the interior concealing flap 32.

Figure 4:
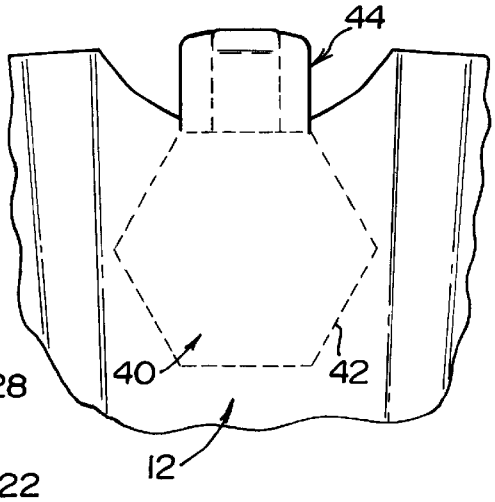
FIG. 4 is a detail of a modified form of coupon.

FIG. 4 illustrates a coupon 40, also defined by severance lines 42 and including an integral tab 44 with flap, which is intended to suggest a wide variety of promotion enhancing configurations which are limited in size only by the actual size of the front wall 12 of the carton. The tab 44, as with the previously described tab 28, is only of a size as to cover a minor area of the coupon 40 sufficient to conceal indicia indicating the validity of the award. The amount of material required is thus minimized. While not limited thereto, other coupon configurations can include triangles, ovals, circles, free forms, etc.

As will be appreciated, the promotional material, that is the coupon 22 and tab 28 with flap 32, can be alternatively defined on the rear wall 14 of the carton. Such a positioning, noting FIGS. 5–8 in particular, would be specifically adaptable to the type of carton 46 referred to as a hash brown carton wherein the front wall 48 thereof is generally opened to facilitate both a filling of the carton 46 and access to the carton contents.

The coupon 22', tab 28' and flap 32' of FIGS. 5–8 duplicate these elements in the first embodiment and are similarly accessed as will be apparent from FIG. 6 and 7. As will be appreciated, the open front of the carton 46 will facilitate an actual opening of the concealing flap 32' prior to a severing of the coupon 22' should this be considered desirable, as for example prior to a consuming of the contents of the carton 46.

FIG. 8 is of interest in illustrating the blank 50 from which the carton 46 is formed and shows the manner in which the tab 28', which is the only addition to the basic conventional blank other than for the coupon perforation lines, is formed as a coplanar extension of the upper edge of the main wall of the blank.

Figure 9:
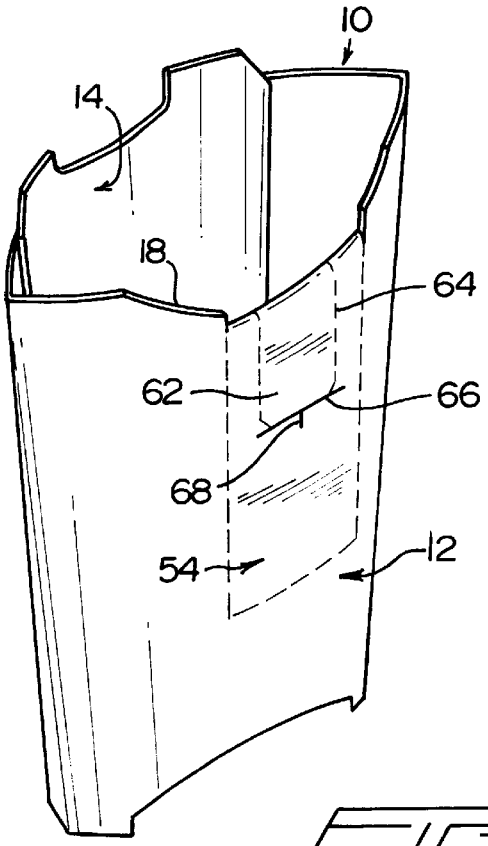
FIG. 9 is a perspective view illustrating a fry carton with a modified form of coupon and tab.
Figure 10:
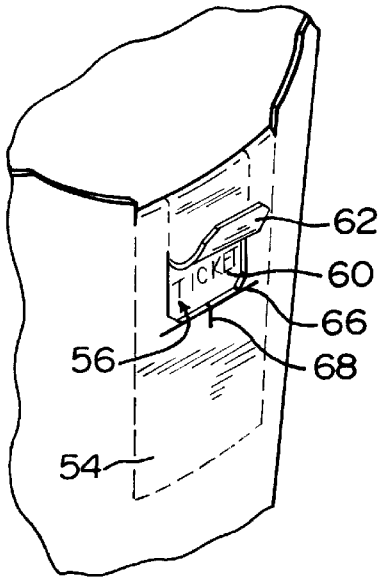
FIG. 10 illustrates the tab flap partially opened to reveal the prize.
Figure 11:
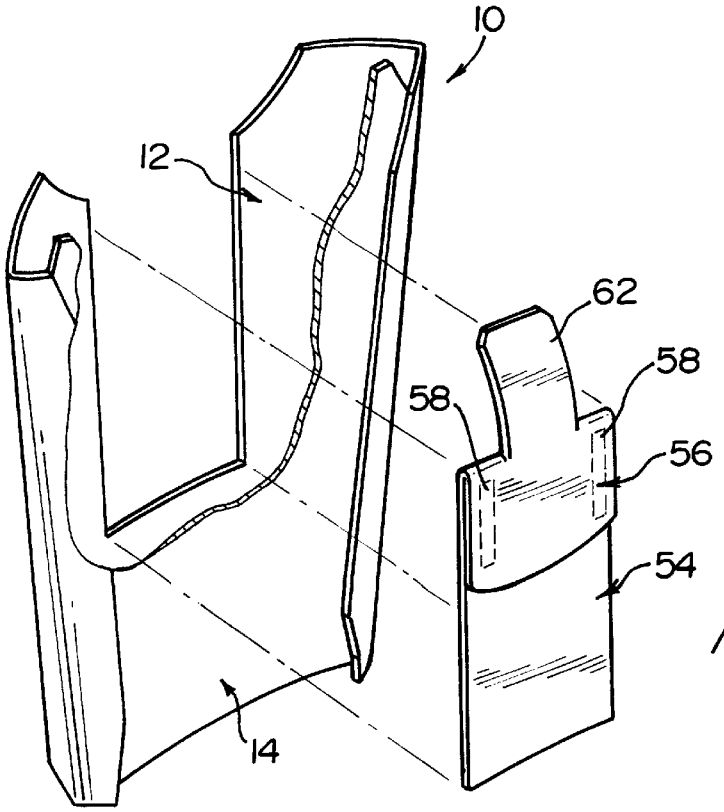
FIG. 11 is an illustration of the coupon removed.
Figure 12:
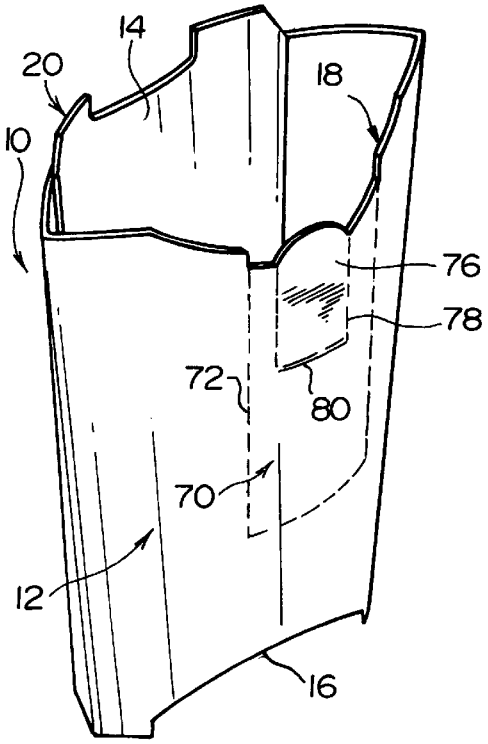
FIG. 12 illustrates a fry carton with a further variant the coupon and tab.
Figure 13:
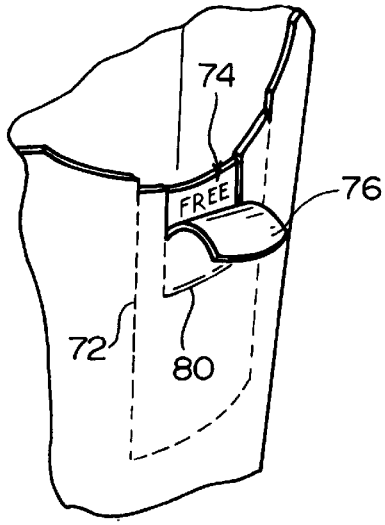
FIG. 13 illustrates the tab flap partially opened.
Figure 14:
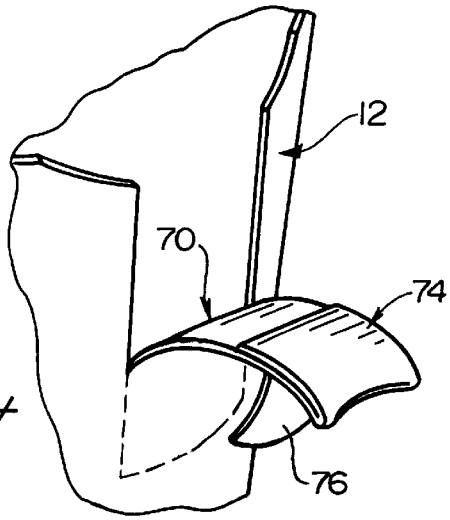
FIG. 14 illustrates the coupon partially removed.
Figure 15:
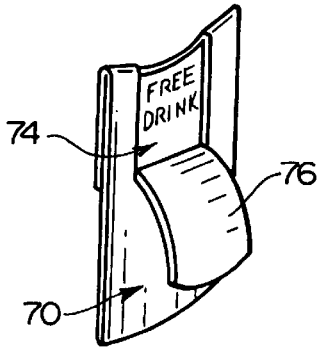
FIG. 15 is a perspective view of the removed coupon with the tab flap fully exposing the prize or value of the coupon.
Figure 16:
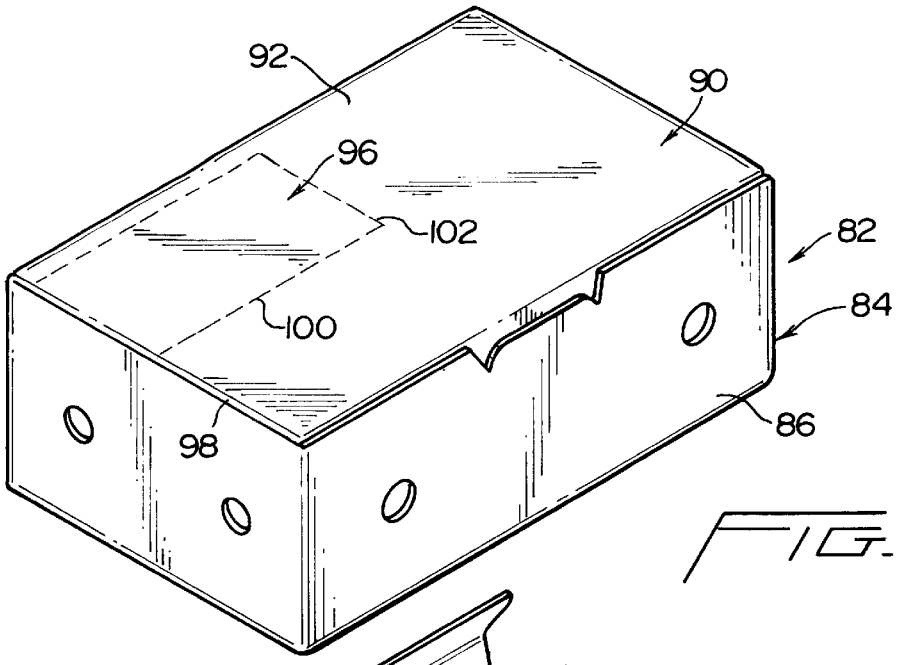
FIG. 16 illustrates a nugget box with a flat lid and with the coupon and tab of the invention incorporated in the lid.
Figure 17:
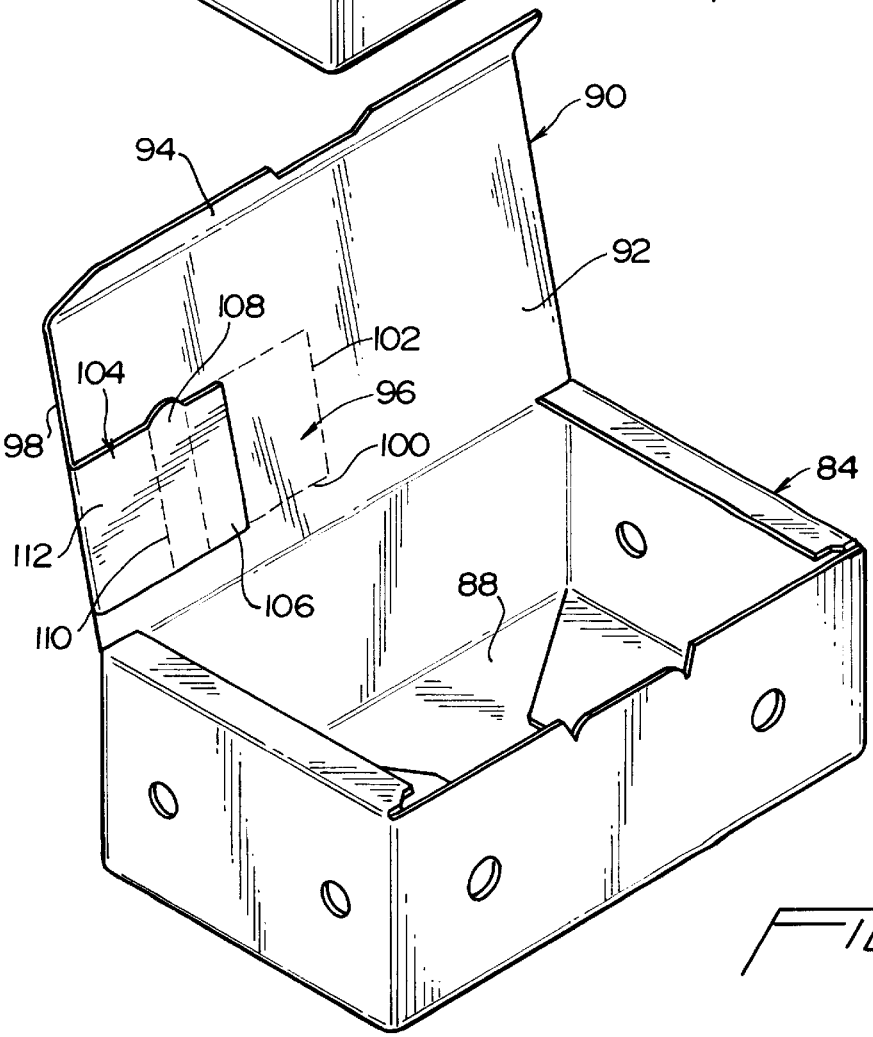
FIG. 17 is a perspective illustration of the nugget box with the cover open and illustrating the tab.
Figure 18:
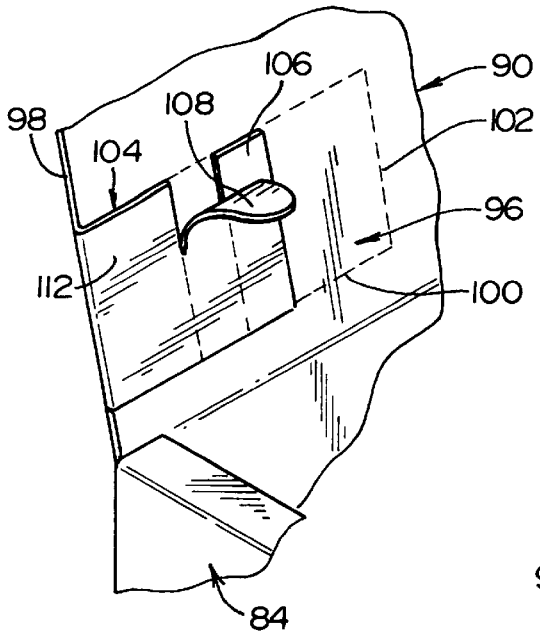
FIG. 18 illustrates a partial removal of the release strip which allows the tab flap to open.
Figure 19:
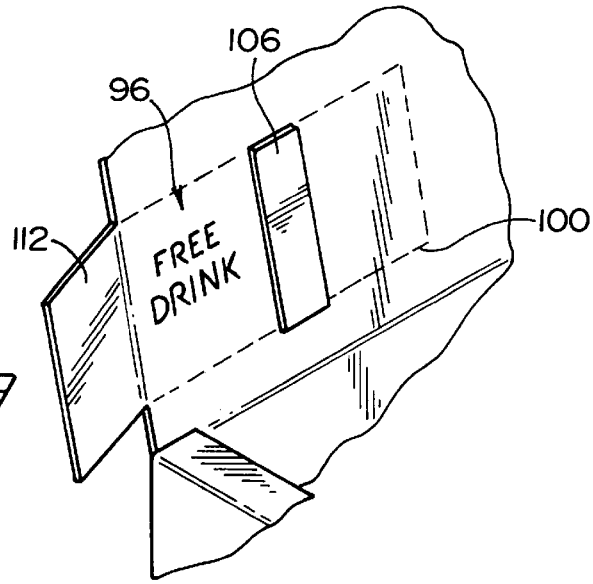
FIG. 19 illustrates the tab flap in its open position.
Figure 20:
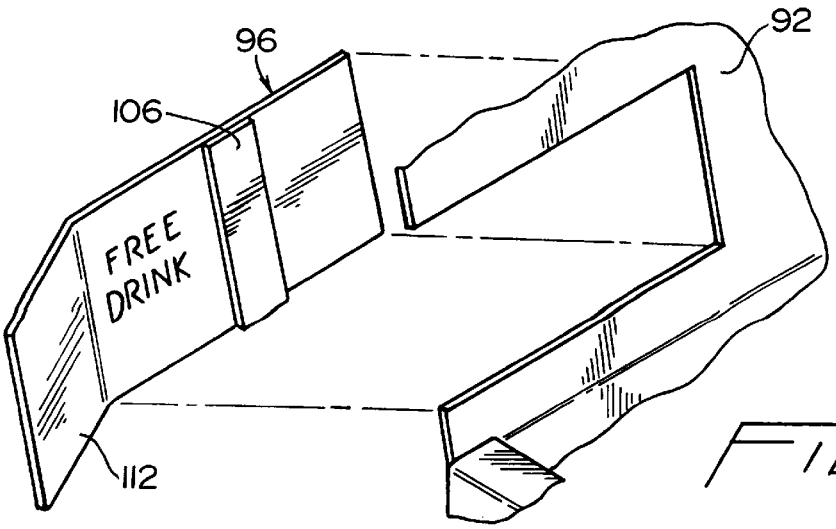
FIG. 20 illustrates the coupon completely separated from the box.
Figure 21:
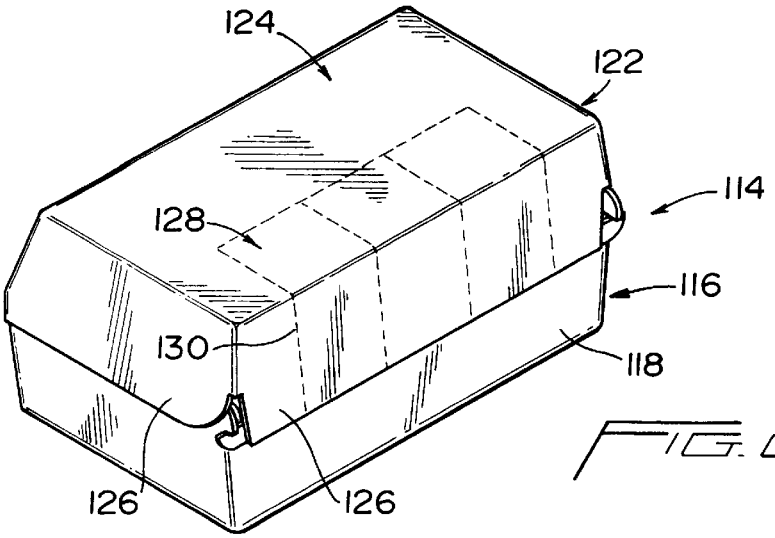
FIG. 21 illustrates a clamshell box of the type normally used to accommodate hamburgers and with multiple coupons defined through both a wall and the top panel of the cover.
Figure 22:
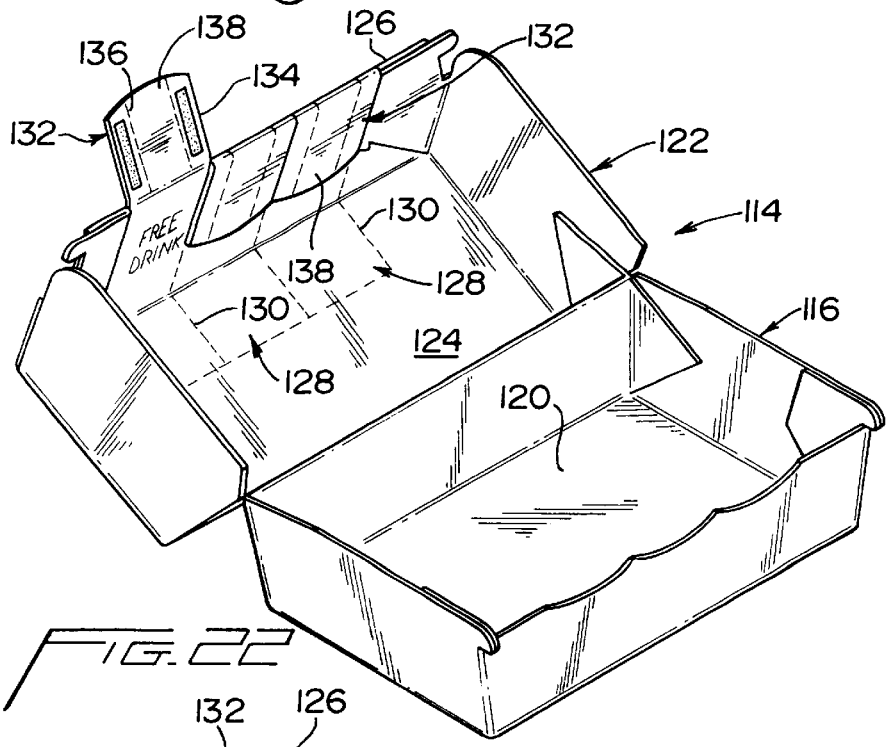
FIG. 22 illustrates the cover open and one of the tabs as it appears prior to folding with the side glue lines exposed.
Figure 23:
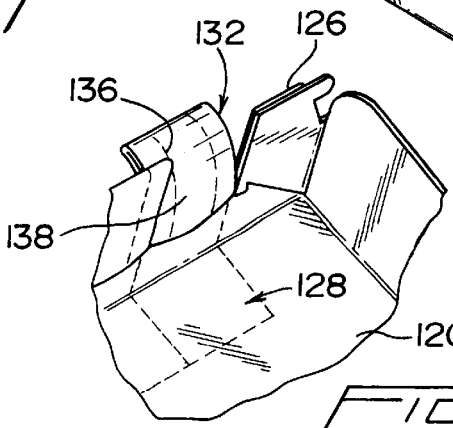
FIG. 23 is a perspective detail with one of the coupons partially removed.
Figure 24:
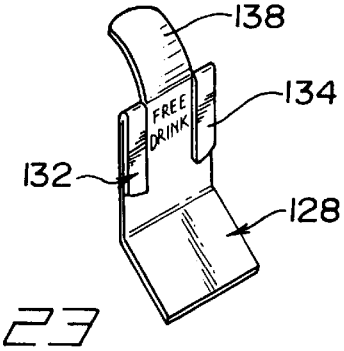
FIG. 24 is a perspective view of the completely removed coupon with the tab flap opened to reveal the concealed prize.

FIGS. 9–11 again illustrate the basic french fry carton 10 wherein the front wall 12 thereof has been modified to incorporate promotional material in accord with the invention. In this embodiment, the coupon 54 is similarly defined within the front wall 12 downward from the upper or top edge 18 thereof by severance lines or lines of perforations which form the outline of the coupon downward from the upper edge 18.

A tab 56, integral with the upper edge of the coupon 54, is folded rearwardly into overlying relation with the rear face of the coupon and is adhesively bonded thereto along the edge portions of the tab 56 as indicated at 58, thereby leaving the vertical central extent of the tab free of adhesive or direct bonding to the coupon 54. The tab 56, similar to the previously described embodiments, is relatively small as compared to the enlarged coupon which, preferably in size and configuration, bears some resemblance to the prize afforded thereby, for example a movie ticket as in the illustrated embodiment.

The coupon 54 is so designed as to allow access to the indicia 60, which indicates the validity or nature of the award, without accessing the interior of the carton 10 or the rear face of the front wall 12, and also without necessitating a removal of the coupon. As such, the purchaser can easily determine his reward prior to and without disrupting the contents of the carton.

Basically, the flap 62 concealing the indicia is located on the vertical center line of the coupon 54 itself and defined therefrom by a laterally spaced vertical severance lines 64 which extend to a transverse cut line 66 defining the bottom of the flap 62 and projecting slightly beyond the opposed side edges thereof. The flap 62 is of a transverse width slightly less than the distance between the tab glue areas 58, and terminates, at the lower cut-line defined edge thereof slightly above the lower edge of the secured tab 56. As such, the lower edge of the flap 62 can be easily engaged from the front of the carton 10 and peeled upward to disclose the award-indicating indicia 60 printed on the underlying face of the now exposed portion of the tab 56. Incidentally, as will be appreciated, and depending upon the particular printing procedures desired, the indicia can appear on the undersurface of the flap 62, or for that matter on both the flap and tab surfaces. Actual access to the lower edge of the flap 62, facilitated by the transverse cut line 66, is further facilitated by a vertical cut line 68 depending from the cut line 66 centrally thereof. Thus, one need merely slightly depress the front wall 12, or more particularly the coupon 54, immediately below the flap for a finger engagement with the bottom edge of the flap and a subsequent upward severing of the flap along the side severance line 64.

It will be appreciated that the flap remains an integral portion of the coupon, and thus is not an extra small scrap of paperboard which, if indiscriminately left or thrown away could provide unnecessary litter. The coupon itself, if indicated of no value, can remain with and be disposed of with the carton 10. If the coupon is of value, the flap is retained therewith. While this may seem a minor problem, inasmuch as a single fast food outlet can sell hundreds if not thousands of cartoned products everyday, it is particularly desirable to avoid having to pick up or retrieve an equal number of small pieces of paperboard as would be the case if the flaps were completely severable.

FIGS. 12–15 illustrate a further embodiment wherein a basic carton 10, with front and rear walls 12 and 14, a bottom 16 and upper wall edges 18 and 20, is provided with a particularly desirable variation in the promotional material. In this embodiment, the coupon 70, similar to the previously described coupons, is formed downward from the top edge 18 along the center line of the front wall 12 by appropriate side and bottom severance lines 72. The coupon 70 is preferably of a vertically elongate rectangular configuration simulating a movie or event ticket. The tab 74, integral with the upper edge of the coupon 70, is folded rearwardly thereof and bonded to the rear face of the coupon 70 solely along the lateral edge portions thereof. As will be recognized, the tab extends only along a very minor portion of the height of the coupon.

The indicia concealing flap 76 is defined from the coupon 70 itself by appropriate laterally spaced side severance lines 78 extending downward from the upper edge of the coupon. In order to more particularly define the flap 76 and facilitate access thereto, the upper edge of the flap is upwardly arced and extends above the upper edge of the coupon 70. This projecting upper end of the flap is actually defined from a corresponding portion of the tab 74 as the tab is rearwardly folded to its secured position with an appropriate cut line allowing for a retention of a minor cut out portion of the upper end of the tab as a planar extension of the flap above the fold line. This construction will be readily apparent from FIGS. 12 and 14.

With the flap 76 formed in this manner, the award-indicating indicia can be applied either to the concealed face of the tab as illustrated, or the concealed face of the flap 76 itself. Further, it will be recognized that the flap 76 can be downwardly stripped, folding about a bottom fold line 80, without affecting the structural integrity of the carton 10, thus allowing for an immediate opening of the potential prize. With this embodiment, as the flap 76 will be downwardly peeled, the carton need not be awkwardly grasped or squeezed as the flap is opened. Rather, the opening force on the flap will be in a downward direction toward the bottom 16 of the carton and a table or the like on which the carton will normally sit. Thus, the contents of the carton are not disrupted or spilled.

One adaptation of the integral promotional material of the invention to a carton in the form of a nugget box 82 is illustrated in FIGS. 16–20. Such a box 82 will normally comprise a base 84 with peripheral walls 86 extending upward from a planar bottom 88. A top 90, normally consisting of a top wall 92 and a front locking flap 94, is integrally joined along the upper edge of the rear wall of the base 84 and folds downward to releasably lock to an upper edge portion of the front wall.

The integral promotional material of the invention is an integral portion of the top wall 92 with the elongate or enlarged coupon 96 defined inwardly from a free side edge 98 of the top wall 92 by laterally spaced severance lines 100 and an inner transverse severance line 102.

The tab 104 extends integrally from the edge 98 transversely coextensive with the coupon 96 and is folded to underlie only a portion of the coupon 96. In this embodiment, only the outer edge portion 106 of the tab 104 is adhesively bonded to the underface of the coupon 96 with the tab 104, from the edge fold to this outer edge portion 106 remaining free of adhesive.

Immediately adjacent the adhesively bonded outer edge portion 106, the tab is provided with an integral transverse release strip 108 defined by laterally spaced severance lines 110 extending across the full transverse width of the tab 104. This release strip 108 may include a slightly extended end for facilitating access thereto.

Upon a removal of the release strip 108, the flap 112, defined between the release strip 108 and the tab fold line is free to outwardly open so as to reveal the concealed prize or award. This sequence of steps will be noted in FIGS. 18 and 19, and allows for a revealing of the award without a destruction of the box top or cover until such time as the carton has fulfilled its use as a container for foodstuff. As noted in FIG. 20, at the appropriate time the coupon and tab can be removed as a unit. The release strip 108, as a natural step in the downward stripping thereof from the top wall 92, will tend to merely fall into the carton base for disposal therewith.

A final embodiment to be specifically illustrated will be seen in FIGS. 21–24 and is in the nature of a conventional clamshell carton 114 comprising a tray 116 with peripheral walls 118 arising from a generally planar base 120, and a similarly configured cover 122 consisting of a top wall 124 and depending peripheral walls 126 which correspond to the tray walls 118 and, at least along the sides and front thereof, slightly overlap these walls.

This embodiment illustrates two additional significant aspects of the invention which are particularly adapted for larger cartons, such as the illustrated clamshell carton which utilizes a cover with top and side walls. In such a carton, the size and particularly the length of the coupon 128 will extend both transversely across the full height of a cover side wall 126 from the free edge thereof, usually the front wall, and also along a significant portion of the top wall 124 to provide for an enhanced promotional display at the most visible area of the carton 114, that is the front and top thereof. The coupon 128, as with the previously described coupons, will be defined by severance lines 130 within both the cover front wall 126 and the cover top wall 124.

The indicia concealing tab 132 is integral with the outer edge of the coupon 128 at the lower or outer edge of the front wall 126 and is folded under and secured to the coupon 128 along the opposed side edge portions 134 thereof by appropriate adhesive means. Severance lines 136, immediately inward of each of the adhesively secured edge portions 134, define the central flap 138 which can be freely upwardly peeled to disclose the underlying indicia designating the particular award or prize. As will be noted, the tab 132 itself is of a length less than the height of the cover wall 126 within which the coupon is formed and remains as an integral part of the coupon upon removal of the coupon.

With continued reference to the clamshell carton 114, it is to be recognized that while a single coupon and tab promotional item can be provided as above described, the carton, as illustrated, presents multiple adjacent ones of these units with common severance lines 130 between adjacent units. As such, it will be appreciated that the invention also contemplates, depending upon the particular nature and size of the carton, multiple independent or interrelated coupons with hidden awards. The provision of multiple coupons on a single carton enhances the promotional possibilities, allowing for "matching" games, puzzle components, and any of a number of related possibilities wherein multiple pieces, questions and answers, and the like are desired.

As will be recognized, while a number of difference tab relationships and constructions have been presented, they are, in a large part, interchangeable. In other words, it is conceivable that the flap formation and relationship as illustrated in the embodiment of FIG. 11 can be used in the promotional material of the carton of FIG. 21. Other variations will readily occur to those skilled in the art.

From the foregoing, it will be recognized that the present invention advances the art of providing prize coupons and the like on disposable cartons, increasing the promotional value thereof and enhancing the nature of the coupons and the relationship thereof to the actual prize awarded. The best example of this is the provision of coupons of both a size and configuration of an actual movie ticket. This, in conjunction with a distinctive means for concealing the actual award for display only subsequent to a purchase of the carton, or more particularly the foodstuff and carton, are considered to constitute a practical advance in an increasingly crowded art.

The foregoing is illustrative of the features of the invention. While multiple embodiments have been disclosed, it is to appreciated that all practical embodiments falling within the scope of the claims following hereinafter are considered to be within the scope of the invention.

What is claimed is:

1. A carton with integral promotional material, said carton including a carton wall with a free edge, said promotional material comprising a coupon defined within said wall inward from said free edge and by at least one severance line extending inward from said free edge and encircling said coupon for selective severance of said coupon from said wall, a tab integral with said coupon along said free edge and overlying only a portion of said coupon for cooperation with the overlaid portion of said coupon in the concealing of information relating to the promotional significance of the coupon, and an integral flap in the plane of and defined from one of said coupon and said tab by at least one severance line, said flap overlying said information and being selectively peelable away from said coupon and said tab to expose said information.

2. The carton of claim 1 wherein said coupon is of a predetermined width, said tab being of a width no greater than the width of said coupon for removal from said carton with said coupon upon a severance of said coupon from said carton.

3. The carton of claim 2 including an adhesive bonding a peripheral portion of said tab, laterally of said flap, to said coupon.

4. The carton of claim 3 wherein said flap is defined from said tab.

5. The carton of claim 4 wherein said tab is bonded to said coupon along opposed laterally spaced edges of said tab with said flap defined therebetween.

6. The carton of claim 4 wherein said tab has an outer end portion remote from said free edge of said carton wall, said outer end portion comprising said peripheral portion bonded by said adhesive, a release strip defined in said tab transversely thereacross and inward of said outer end portion, said tab, between said release strip and said free edge of said carton wall, comprising said flap.

7. The carton of claim 3 wherein said flap is defined in said coupon and extends inwardly from said free edge of said carton wall in overlying relation to said tab, said flap being dimensionally smaller than said tab.

8. The carton of claim 7 wherein said flap includes a projecting end at said free edge of said carton wall, said at least one severance line defining said flap comprising a pair of laterally spaced severance lines extending in said coupon from said free edge of said carton wall to an inner end of said flap, said inner end of said flap being integral with said coupon wherein an opening of said flap is effected by a downward peeling thereof.

9. The carton of claim 7 wherein said flap includes an outer end integral with said tab at said free edge of said carton wall, and an inner end spaced therefrom and defined in said coupon by a transverse cut line partially across the width of said coupon, said at least one severance line forming said flap comprising two severance lines extending through said coupon from said free edge of said carton wall to said cut line, said cut line allowing free access to said inner end of said flap for an upward peeling of said flap toward said integral outer end thereof and a corresponding exposure of the tab therebelow.

10. The carton of claim 9 including a second cut line in said coupon longitudinally aligned with said flap and intersecting said first cut line and combining therewith to facilitate an inward flexing of said coupon immediately adjacent said inner end of said flap for access thereto.

11. The carton of claim 3 wherein said carton includes a second carton wall integral with said first-mentioned carton wall remote from said free edge thereof, said coupon extending beyond said first mentioned carton wall and partially across said second carton wall, said tab extending from said free edge of said first mentioned carton wall to a point intermediate said free edge and said second carton wall.

12. The carton of claim 11 including multiple duplicate coupons, each with an associated tab, positioned in adjacent relationship along said first-mentioned carton wall.

13. The carton of claim 12 wherein said carton is a clamshell carton including a tray and overlying cover, said cover having a front wall and a top wall respectively comprising said first-mentioned carton wall and said second carton wall.

14. The carton of claim 11 wherein said carton is a clamshell carton including a tray and overlying cover, said cover having a front wall and a top wall respectively comprising said first-mentioned carton wall and said second carton wall.

15. The carton of claim 3 wherein said coupon is of an elongate rectangular configuration and of a substantially greater length, inward from said free edge of said carton wall, than said width.

16. A folded paperboard carton including a carton wall with a free edge, a removable coupon defined in said carton wall by severance lines extending inward from said free edge, a tab integral with said wall at said free edge and folded to overlie a portion of said coupon, said coupon extending substantially beyond said tab, a flap in the plane of and defined from one of said coupon and said tab, said flap being dimensionally smaller than said tab and selectively severable to expose an inner face of said tab normally concealed between said tab and said coupon.

17. The structure of claim 16 wherein said flap is defined from said tab.

18. The structure of claim 16 wherein said flap is defined from said coupon in direct overlying relation to said tab.

* * * * *